US005102019A

United States Patent [19]

Lam

[11] Patent Number: 5,102,019

[45] Date of Patent: Apr. 7, 1992

[54] MOTORIZED ADJUSTABLE CLOTHES HANGER

[76] Inventor: Peter A. Lam, Castle Peak Road, N.T., Tsing Lung Tau, Hong Kong

[21] Appl. No.: 595,438

[22] Filed: Oct. 11, 1990

[51] Int. Cl.[5] ..... A479 25/44; A479 25/20; A479 25/14

[52] U.S. Cl. ..... 223/94; 223/89; 223/92; 223/85; D6/318; D6/324

[58] Field of Search ..... 223/89, 94, 88, 85, 223/95; D6/315, 324, 318; 311/113

[56] References Cited

U.S. PATENT DOCUMENTS

| | | | |
|---|---|---|---|
| 923,786 | 6/1909 | Geraci | 223/94 |
| 2,436,314 | 2/1948 | LeSavoy | 223/89 |
| 2,477,873 | 8/1949 | Hopkins et al. | 223/89 |
| 2,494,272 | 1/1950 | Whitsel | 223/89 |
| 2,494,711 | 1/1950 | Kusher et al. | 223/94 |
| 2,504,562 | 4/1950 | Melcher | 223/89 |
| 2,513,980 | 7/1950 | Widmann | 223/89 |
| 2,679,958 | 6/1954 | Massa et al. | 223/89 |
| 2,716,512 | 8/1955 | Needles | 223/89 |
| 2,900,117 | 8/1959 | Veltry | 223/94 |
| 2,919,839 | 1/1960 | Burns | 223/95 |
| 2,944,711 | 7/1960 | Sage | 223/94 |
| 3,024,954 | 3/1962 | Michlin | 223/95 |
| 3,039,662 | 6/1962 | Strong | 223/89 |
| 3,874,572 | 4/1975 | McClenning | 223/94 |
| 4,593,839 | 6/1986 | Vandros | 223/95 |
| 4,717,053 | 1/1988 | Wang | 223/94 |

FOREIGN PATENT DOCUMENTS

| | | | |
|---|---|---|---|
| 490912 | 2/1954 | Italy | 223/89 |
| 887020 | 1/1962 | United Kingdom | 52/5 |

*Primary Examiner*—Werner H. Schroeder
*Assistant Examiner*—Bibhu Mohanty
*Attorney, Agent, or Firm*—Lawrence S. Cohen; Arthur Freilich

[57] ABSTRACT

A clothes hanger in which each hanger arm is adjustable in length by means of an extender arm mounted for and operated by a mechanical system so that the extender arms move simultaneously either inward or outward by the same distance. The mechanical system may be hand operated or driven by an electric motor.

9 Claims, 3 Drawing Sheets

FIG. 1
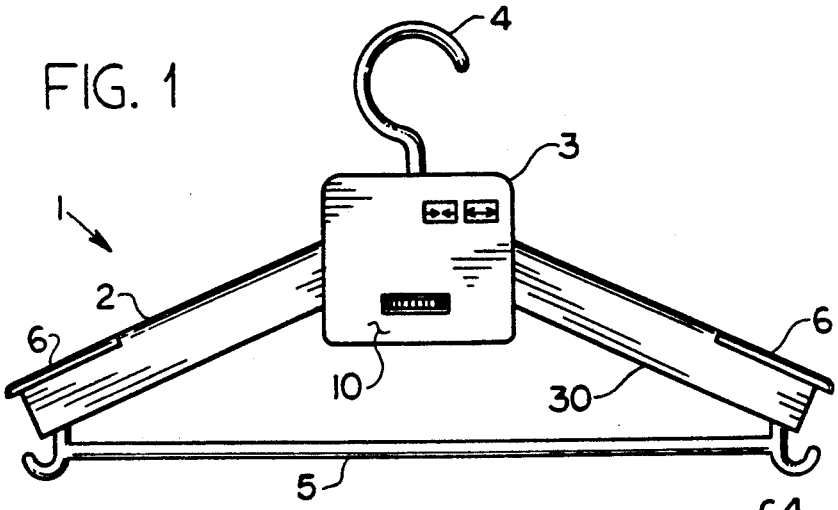
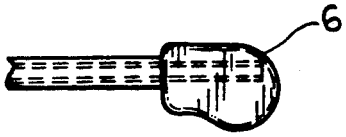
FIG. 1a
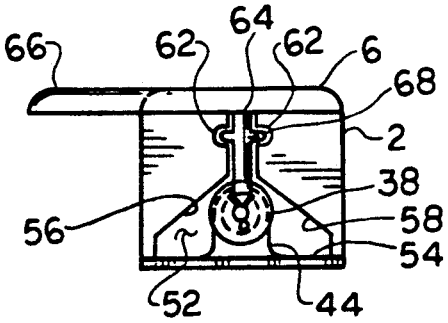
FIG. 1b
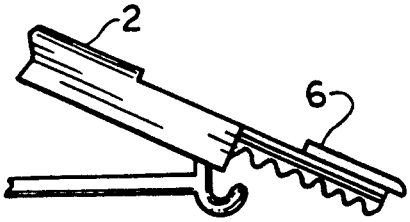
FIG. 2
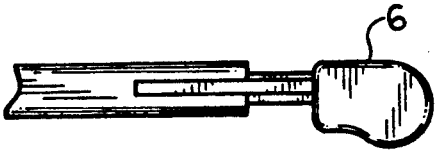
FIG. 2a

A
A
M

MOTORIZED ADJUSTABLE CLOTHES HANGER

BACKGROUND

This invention relates to clothes hangers. In particular, it relates to clothes hangers of the type in which the hanger arms for supporting a clothes item are adjustable in length.

Clothes hangers of fixed construction have the disadvantage that clothing of different styles and shapes and sizes do not all fit on the hanger equally well. As a result, clothes which are misfit to the shape or size of the hanger, hang in a deformed manner which causes wrinkling and misshaping of the cloth. Hangers having various adjustable aspects are known, including adjustment to the length of the hanger arm.

The following are exemplary of the prior art; U.S. Pat. Nos. 923,786; 2,436,314, 2,494,711; 2,504,562; 2,679,958, 2,716,512; 2,900,117; 2,944,711; 3,039,662; 3,874,572 and 4,717,053 and United Kingdom Patent 887,020.

SUMMARY OF THE INVENTION

The present invention is an adjustable clothes hanger which permits adjustment of the length of the hanger arms in order to accommodate different shapes and sizes of clothing and to thereby permit smooth hanging of clothing. The present invention provides such an adjustable length clothes hanger which is driven by an electric motor, or can be driven by hand, through a transmission mechanism which adjusts the two hanger arms simultaneously and provides a wide range of variation in size.

The invention provides a hanger with two support arms upon each of which are fitted an extender arm. The extender arm on each support arm is slidable from an innermost position providing the shortest length to an outermost position providing the longest length. The extender arm is supported against twisting out of longitudinal alignment, but allowing the full range of adjustment between the innermost and outermost positions. The extender arms are adjustable by means of a mechanism extending from each extender arm along its associated support arm to a centrally located junction point. The mechanism for adjusting the extender arms can be operated so that they are adjusted simultaneously and by an equal amount. The mechanism can be driven by hand, or by an electric motor. The motor may be powered by batteries or conventional house current through a transformer and AC to DC converter.

In a preferred embodiment of the invention, the support arms extend outwardly and are angled downwardly from a central hanging point. The support arms join to a junction member which provides the mounting structure for the driving mechanism. On each support arm an extender arm is fitted for sliding movement from an innermost position point to an outermost position point. The extender arm can be set at any point between these two positions, and is prevented from twisting by mating surfaces between the support arm and the extender arm. In one embodiment a drive mechanism is mounted on the junction member comprising a crown gear which drives two bevel gears. The crown gear can be operated by hand through a hand wheel or by a motor through a reduction gear. Each bevel gear is mounted on a shaft which extends inside the respective support arms. The shafts are rotatably supported at one end near the bevel gear and at the opposite end near the far end of the support arm. Mounted on each shaft, near the far end of the support arm is a worm gear. The worm gears have the same pitch and lead distances and the same pitch direction (either left hand or right hand). The worm gears mesh with a rack gear on each extender arm. Therefore, rotation of the crown gear causes the bevel gears and their respective shafts to rotate in opposite directions. The worm gears will also rotate in opposite directions and as they are of the same pitch direction, they will impart simultaneous translation, through the rack gears, of the extender arms either both outwardly or both inwardly.

In another preferred embodiment, each shaft has instead of a worm gear, a long screw. One or more nuts are placed on the screw and fixed to the extender arm. The screws are of the same configuration as the worm gears in the prior embodiment. Thus, as the screws turn, the nuts translate and the extender arms move simultaneously inwardly or outwardly.

In another preferred embodiment the driving mechanism has attached to it a capstan while there is a pulley at the end of each support arm. Between the capstan and each pulley a cable is strung. The extender arm is attached to the cable by one or more clamps. The cable segments for one support arm are reversed in order that both extender arms move either outwardly or inwardly together. Therefore, rotation of the capstan will move the cable and the extender arm simultaneously inwardly or outwardly depending on the direction of rotation of the capstan.

The novel features of the invention are stated with particularity in the Claims. The invention will be best understood when the detailed description is read in conjunction with the drawings.

BRIEF DESCRIPTION OF THE DRAWINGS

FIG. 1 shows a front view of a first embodiment of the invention with the extender arms in their innermost position.

FIG. 1*a* shows a partial top view of the embodiment of FIG. 1.

FIG. 1*b* shows an end view of the extender arm.

FIG. 2 shows a front view of one hanger arm assembly of the first embodiment, with the extender arms in an extended position.

FIG. 2*a* shows a top view of the embodiment of FIG. 2.

DETAILED DESCRIPTION

The Device

Figures 3, 4, 5:
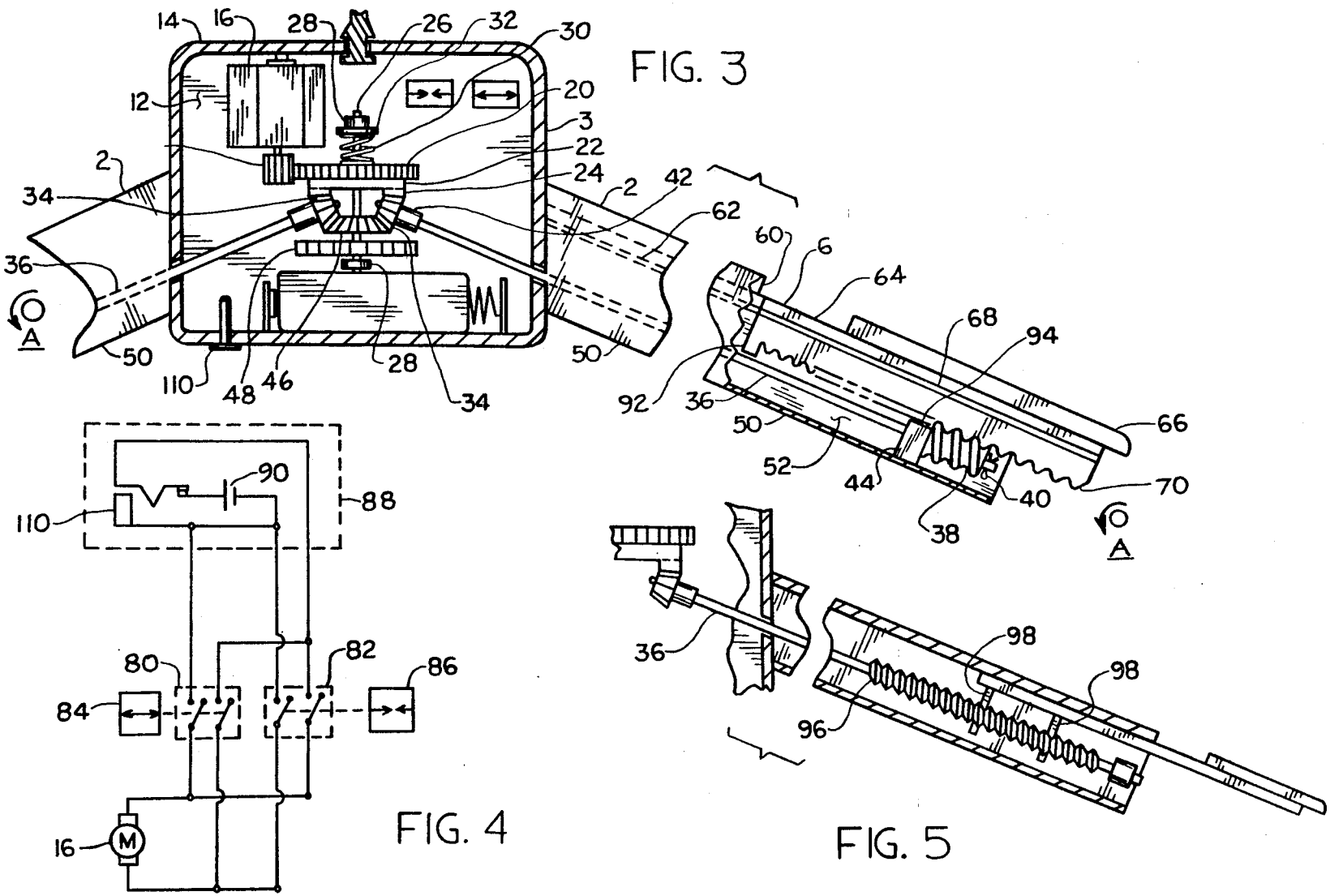
FIG. 3 shows a detail partial view of the first embodiment.
FIG. 4 shows a circuit diagram of the first embodiment.
FIG. 5 shows the transmission mechanism of a second embodiment of the invention.

Referring to FIGS. 1, 1*a*, 1*b*, 2 and 2*a*, the clothes hanger 1 in accordance with the present invention includes a pair of support arms 2, a junction member 3, a hook 4, and a cross-bar 5. Extender arms 6 are fitted for sliding movement on each of the support arms 2. In FIG. 1, the extender arms 6 are shown in their most retracted position, providing the shortest clothes hanging configuration. In FIG. 2, the extender arms are shown in an extended position providing a longer clothes hanging configuration.

In the following description, the singular may be used to explain a mechanism which is identically repeated on the left and right sides of the hanger, these being for the most part identical. Where they differ, the difference is explained.

The detailed description of construction and operation of this embodiment are now described with reference to FIGS. 1 through 4. Referring to FIG. 3, the junction member 3 is a box-like structure which preferably includes a cover 10, (shown in FIG. 1), a floor 12 and sides 14. The hook 4 is rotatably mounted through an opening in the side 14. Mounted in the junction member 3 are the mechanical elements to drive the extender arms 6. A motor 16 has a drive pinion 18 driving a spur gear 20 which is part of a combination gear 22. The other part of the combination gear 22 is a crown gear 24. The combination gear 22 is rotatable on a shaft 26 which is mounted on bearings 28; the bearings 28 being fixed to the floor 12 of the junction member 3. The combination gear 22, and the shaft 26 in conjunction with spring 30 and retainer 32 function as an override clutch, by the spring urging the combination gear 22 into its operative position and by allowing it to slide on the shaft 26 towards the retainer 32 when the spring force is overcome by another opposite thrust force. This can occur when the extender arm is in its fully retracted or extended positions.

The crown gear 24 meshes with and drives a pair of bevel gears 34, transmitting rotational motion through shafts 36, which are mounted along and parallel to the support arms 2. At the other end of the shafts 36 are worm gears 38, which can be held in place by pins 40. The shafts 36 are supported at one end on bushings 42 which can be mounted on or molded as part of the junction member 3, and at the other end by bushings 44 which can be mounted on or molded as part of the support arms 2. Mounted below the bevel gears 34 is an idler bevel gear 46, on shaft 26. Also on shaft 26 is a thumb wheel 48 which is fixed to or built as part of the idler bevel gear 46.

The support arms 2 have a body 50 which has a hollow slide shaft 52 for containing the extender arm 6 as well as the shaft 26 and worm gear 38. One portion of the slide shaft 52 is formed to retain and permit translation of the extender arm 6 by internal side surfaces 54, 56 and 58. Opposed guide slots 62 are formed in the surfaces 56 and 58. The outer periphery of the support arm 2 is generally rectangular in cross section. There is a step down 60 for convenient nesting of the extender arm 6. The extender arm has a body 64, a shoulder pad 66, guide ribs 68 extending from each side of and along the body 64, and a rack gear 70 formed along the bottom of the body 64.

The extender arm fits into and slides within the slide shaft 52, the guide ribs 68 riding within the guide slots 62. The rack gear 70 is in mesh with the worm gear 38.

As can be seen at points A, the direction of rotation of the shafts is counterclockwise (or clockwise in reverse) as seen from the end of each support arm. In order to accomplish simultaneous inward and outward movement the worm gears 38 have the same handedness, that is both either right-handed or left-handed. Also they must have the same pitch, lead distance and pitch diameter.

Now referring to FIG. 4, the electrical circuit will be described. There are a pair of two position control switches 80 and 82 which are operated by control buttons 84 and 86. These are spring loaded switches in the normally open position. A single three position switch could be substituted. A receptacle 110 is provided for receiving external power to drive the motor.

The power module 88 provides power to the motor 16. A small battery 90 is employed. The battery is wired to the motor through the switches 80 and 82. By closing switch 80, the motor 16 will run in one predetermined direction. By closing switch 82 the motor 16 will run in the opposite direction. Power may also be obtained from an external source for operating the motor, or to charge the battery through a jack 90. In order to prevent the extender arms 6 from dropping out of the support arms 2, a stop device can be employed. A stop 92 is placed at the end of the rack gear 70. Also a detent 94 is part of the bushing 44. Therefore, the extender arm 2 cannot be extended beyond the point of contact of the stop 92 and the detent 94.

As will be apparent, the gear shapes and meshing arrangements do not require the type of precision associated with machinery such as machine tools. Instead due to the low loads and low level of precision, relatively inexact dimensions will suffice. For the same reasons the driving and power transmitting parts may be made of plastic or inexpensive metals.

In operation, it is generally desired to adjust the position of the extender arm 6 to accommodate an item of clothing. For this description, it will be assumed that the hanger is initially set with the extender arms 6 in the most retracted position as shown in FIG. 1. Control button 84 is operated to close switch 80 and energize the motor 16. Pinion gear 18 rotates, and in mesh with combination gear 22 through bevel gears 34 the shafts 36 rotate as do the worm gears 38. The worm gears 38 drive the rack gears 70 in linear translation, sliding the extender arm 6 outwardly relative to the support arms 2. When the button 84 is released, the switch returns to the open position and the movement stops. By operating the button 86, the motor 16 will operate in the opposite direction reversing the entire mechanism. When the extender arm is fully extended, the stop 92 will strike the detent 94. This will freeze the worm gear 38, the shaft 38 and the bevel gear 34. Then if the motor is still energized, the crown gear 24 will jump out of mesh moving the entire combination gear 22 upward, overcoming the engaging force of the spring 30, until the power is shut off.

An alternative embodiment is illustrated in FIG. 5. In this embodiment the structure is identical to that already described except for the means used to transfer the rotary motion of the shaft 36 to the extender arm 6. In this embodiment a screw 96 is placed on or made integral with the shaft 36. The extender arm 6 has attached a pair of nuts 98 which are threaded onto the screws 96.

Figure 6:
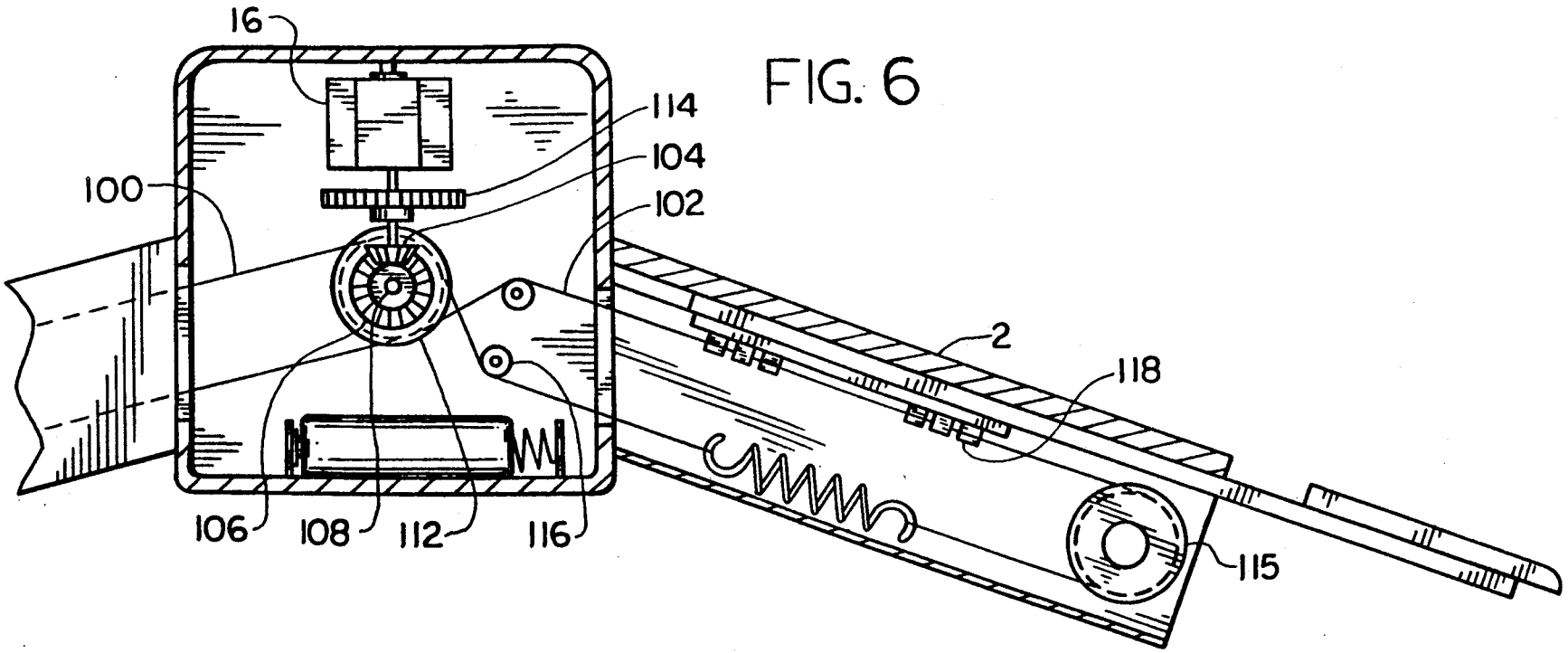
FIG. 6 shows the transmission mechanism of a third embodiment of the invention.

A still further embodiment is shown in FIG. 6. In this embodiment cables 100 and 102 are used to transfer motion from the drive source to the extender arms 6. The motor 16 has attached to its shaft a bevel gear 104, which meshes with a crown gear 106 on a shaft 108 in turn fixed to the junction member, such as being pressed into a boss. This provides a 90° drive. The capstan 112 is also freely mounted on the shaft 108 and is attached to the gear 106 by any convenient means such as by pins or glue, or by molding from a single piece. A thumb wheel 114 allows manual operation.

The cables 100 and 102 are wrapped around the capstan 112 and extend along the support arms 2 and then wrap around the pulleys 115. Cable 102 is reversed by idlers 116. The upper length of cables 100 and 102 are clamped onto the extender arms 2 by clamps 118. Two clamps are preferred but a single clamp could be used.

Therefore, in use, rotation of the capstan 112 will cause simultaneous inward or outward movement of the extender arms 6.

The foregoing embodiments are exemplary of the means available to practice the present invention. Equivalent constructions within the scope of the appended claims may be devised by persons skilled in the art. For example only, frictional drive by surface-to-surface contact could be substituted for the disclosed gear based drive assembly.

I claim:

1. An adjustable hanger comprising;

a pair of support arms extending from and attached to a junction area, the support arms terminating in a free end;

a pair of extender arms each freely slidably mounted proximate the free end of one of the support arms for free sliding translational movement of the extender arm lengthwise of the respective support arms;

a drive mechanism operable from the junction area and connected to each of the extender arms for simultaneously and equally translating the arms either inwardly or outwardly with respect to the respective support arm;

means for applying power and motion to the drive mechanism at the junction area to move said arms inwardly and outwardly;

a transfer mechanism for dividing the drive power and motion into two separate drive paths and for transferring the drive power and motion by means of the two separate drive paths from said junction area to an area near each extender arm;

a conversion mechanism for converting the drive power and motion near each extender arm to translational movement of the extender arm.

2. The adjustable hanger of claim 1 wherein a hand-operable drive element for operating the drive mechanism is provided at the junction area.

3. The adjustable hanger of claim 1 wherein the drive mechanism comprises a rotatable drive wheel having a power receiving element for being rotatably driven by a power source and having at least one power transfer element and the transfer portion comprises a pair of rotatable power receiving elements each in mechanical engagement with a power transfer element of the drive wheel whereby the rotational motion and power of the drive wheel is transferred to the two power receiving elements.

4. The adjustable hanger of claim 3 wherein the power transfer element of the drive wheel is a crown gear and the pair of power receiving elements are bevel gears in mesh with the crown gear at generally opposite positions and the transfer mechanism is a pair of shafts each fixed to one of the bevel gears and extending lengthwise of a respective support arm terminating near the extender arm and the conversion mechanism comprises, a worm gear on each shaft in mesh with a rack gear on extender arm, the worm gears having the same pitch handedness and pitch distance and diameter.

5. The adjustable hanger of claim 4 wherein the drive mechanism has an electric motor and a pinion thereon and a spur gear on the drive wheel in mesh with the pinion and switching means for operating the motor in either direction, or turning it off.

6. The adjustable hanger of claim 5 further comprising a clutch assembly for urging the crown gear into engagement with the bevel gears when in the engaged position and allowing the crown gear to release from engagement with the bevel gears when an opposing thrust force overcomes the urging force wherein the drive wheel is mounted on a shaft for axial motion thereon, and the clutch assembly has a resilient means for urging the drive wheel axially of the shaft into engagement of the crown gear with the bevel gears whereby an opposite thrust force may overcome the engaging force of the resilient means and cause disengagement of the crown gear with the bevel gears.

7. The adjustable hanger of claim 3 wherein the worm gear on each shaft is a drive screw and further comprising at least one driven nut riding on each drive screw and fixed to the respective extender arm.

8. The adjustable hanger of claim 1 wherein said transfer mechanism comprises;

a capstan driven by the drive mechanism; a continuous elongate flexible element around said capstan and extending along each support arm and attached to the respective extender arm;

reversing means associated with one extender arm for reversing direction of the elongate flexible element;

means for keeping the elongate flexible element taught;

an idler pulley on each support arm for returning the elongate flexible member to the capstan;

whereby the elongate flexible member establishes a separate drive path to divide the drive power and motion into two separate drive paths and rotation of the capstan will transfer the power and motion to one elongate flexible member along each drive path and transform said motion from rotational to translational movement and the extender arms will extend and retract equally and simultaneously.

9. An adjustable hanger comprising a pair of support arms extending from and attached to a junction area, the support arms terminating in a free end;

a pair of extender arms each slidably mounted proximate the free end of one of the support arms for sliding translational movement of the extender arm lengthwise of the respective support arm;

a drive mechanism operable from the junction area and connected to each of the extender arms for simultaneously and equally translating the arms either inwardly or outwardly with respect to the respective support arm;

wherein the drive mechanism has an electrical motor for operating the drive mechanism.

* * * * *